United States Patent [19]

Teshima et al.

[11] Patent Number: 4,842,369

[45] Date of Patent: Jun. 27, 1989

[54] CLADDING MATERIAL FOR PLASTIC OPTICAL FIBER AND PLASTIC OPTICAL FIBER USING THE SAME

[75] Inventors: Shinichi Teshima, Yokohama; Shigeki Katsuta, Kawasaki; Kazuhiko Maeda, Akishima; Taku Yamauchi, Kamifukuoka; Toshio Koishi, Sakado, all of Japan

[73] Assignees: Asahi Kasei Kogyo Kabushiki Kaisha, Osaka; Central Glass Company Limited, Yamaguchi, both of Japan

[21] Appl. No.: 241,952

[22] Filed: Sep. 8, 1988

[30] Foreign Application Priority Data

Sep. 9, 1987 [JP] Japan ..... 62-226066

[51] Int. Cl.[4] ..... G02B 6/00; D02G 3/00; C08L 27/12

[52] U.S. Cl. ..... 350/96.34; 350/96.29; 428/373; 525/200

[58] Field of Search ..... 350/96.34, 96.30, 96.29; 428/373, 375, 378, 392, 394, 422; 525/199, 200; 528/220

[56] References Cited

U.S. PATENT DOCUMENTS 4,542,957 9/1985 Ishiwari et al. ..... 350/96.34
4,617,350 10/1986 Maeda et al. ..... 350/96.34 X
4,642,326 2/1987 Yasumura et al. ..... 350/96.34 X
4,687,295 8/1987 Koishi et al. ..... 350/96.34
4,747,662 5/1988 Fitz ..... 350/96.34 X
4,756,599 7/1988 Maeda et al. ..... 350/96.31 X

FOREIGN PATENT DOCUMENTS 0438978 10/1964 Japan .
0190304 2/1985 Japan .
0021606 7/1986 Japan .
0066509 9/1986 Japan .
0143509 12/1986 Japan .
0096908 5/1987 Japan .

*Primary Examiner*—William L. Sikes
*Assistant Examiner*—Akm E. Ullah
*Attorney, Agent, or Firm*—Birch, Stewart, Kolasch & Birch

[57] ABSTRACT

A cladding material for plastic optical fiber comprising a vinylidene fluoride-trifluoroethylene-hexafluoroacetone copolymer which comprises 3.5 to 6.5% by mole of hexafluoroacetone units, a molar ratio of vinylidene fluoride unit to trifluoroethylene unit of 3 to 6:1, and a melt index of 10 to 60 g/10 min, and a plastic optical fiber comprising said cladding material and a methyl methacrylate homopolymer or copolymer which comprises over 50% by weight of methyl methacrylate units as the core material.

4 Claims, No Drawings

CLADDING MATERIAL FOR PLASTIC OPTICAL FIBER AND PLASTIC OPTICAL FIBER USING THE SAME

BACKGROUND OF THE INVENTION

1. Field of the Invention

The present invention relates to a novel cladding material for plastic optical fibers and plastic optical fibers comprising the material.

More particularly, the present invention relates to a cladding material for plastic optical fibers which has a low refractive index and is excellent in transparency, and is characterized with good mechanical properties, compatibility with core material, adhesion to core material, etc.; and relates to plastic optical fibers comprising said cladding material which have a low loss and a large numerical aperture and which are excellent in heat resistance, mechanical properties, processability, flexibility, etc.

2. Discussion of Related Art

In recent years, optical communication techniques using optical fibers as information channels have advanced rapidly and has already been made practicable.

Optical fibers are divided into two groups, i.e., silica glass optical fibers and plastic optical fibers. Compared with silica glass optical fibers, plastic optical fibers are more flexible and have a larger diameter and a larger numerical aperture, and termination and joining between the fibers are easier. Therefore, the application of plastic optical fibers in the fields of wiring in instruments, short-distance communications, sensors and light guides, have been started.

As resins with excellent transparency and processability for plastic optical fibers, there have heretofore been known, for example, polystyrene resins, polycarbonate resin, and polymethyl methacrylate resin.

Polystyrene resins have a refractive index of about 1.59 and good transparency, and hence plastic optical fibers thereof using polymethylmethacrylate resins as cladding materials have been put to practical use. The polystyrene resins, however, are disadvantageous in that they are poor characterized with flexibility and weather resistance properties, and therefore they are not always the most suitable as materials for plastic optical fibers.

Polycarbonate resins have good transparency and a high glass transition temperature of about 150° C., and hence their employment as core materials of optical fibers having a heat resistance of about 120° C. has been considered.

On the other hand, polymethyl methacrylate resins are excellent in transparency but have a relatively low refractive index of about 1.49. Therefore, when a polymethyl methacrylate resin is used as the core material, a resin having a still lower refractive index of about 1.40 should be selected as the cladding material.

As resins having a low refractive index, fluorine-containing methacrylate resins have been known (Japanese Patent Publication No. 43-8978). However, although these resins are advantageous in that they are amorphous and have good transparency and a low refractive index of about 1.41, they have the following defects. Since fluorine-containing methacrylate resins are insufficient in their adhesion to polymethyl methacrylate resins, bending easily disturbs the core-cladding interface of the plastic optical fiber which uses this resin as the cladding material, resulting in a large light loss.

Since fluorine-containing methacrylates are hard and brittle, the plastic optical fiber which uses this resin as a cladding material is poor in mechanical strength and flexibility. Because of the insufficient slippage of bare fiber on one another, the workability at the time of bundling and processing for fabricating a light guide is low.

There has also been disclosed a plastic optical fiber using, as the cladding material, a vinylidene fluoride-tetrafluoroethylene copolymer containing 60 to 80 mole % of vinylidene fluoride units (Jap. Pat. Appln. Kokai (Laid-Open) No. 50-20737). This copolymer is advantageous in that it has a low refractive index of about 1.41 and is excellent in its adhesion to polymethyl methacrylate resins and has good mechanical properties. However, since both vinylidene fluoride and tetrafluorethylene form crystalline polymers, control of the crystallizability by copolymerization is limited and crystallizability remains in the copolymer. Therefore, when light is totally reflected on the core-cladding boundary surface, a portion of the light is scattered and only plastic optical fibers having a relatively high transmission loss can be obtained. Moreover, the copolymer has a defect in that under a temperature condition of 80° C. or higher, the crystals would grow which would lower the transparency, and result in a large increase of attenuation.

There have also been disclosed optical fibers which use vinylidene-fluoride-tetrafluoroethylenehexafluoropropylene copolymers containing less than 45 mole % of tetrafluoroethylene units and 1 to 30 mole % of hexafluoropropylene units [Japanese Pat. Appln. Kokai (Laid-Open) No. 54-80758]. The hexafluoropropylene units serves mainly to control the crystallizability. This copolymer is excellent in its adhesion to polymethyl methacrylate resins and has a relatively high transparency. Plastic optical fibers which use this copolymer as the cladding material and polymethyl methacrylate resin as the core material, initially have a low attenuation. However, when these plastic optical fibers are coated with polyethylene to form a cord and placed in a thermohygrostat having a temperature of 85° C. and a humidity of 95%, the values of the attenuation would be further increased.

There have also been disclosed optical fibers which uses vitreous silica or a polymethyl methacrylate resin as the core material and a vinylidene fluoridehexafluoroacetone copolymer as the cladding material (Jap. Pat. Appln. Kokai (Laid-Open) No. 61-22305, U.S. Pat. No. 4687295Jap. Pat. Appln. Kokai (Laid-Open) Nos. 61-190304 and 62-96908). However, although a vinylidene fluoride-hexafluoroacetone copolymer has a high compatibility with polymethyl methacrylate resins, it is disadvantageous in that it retains a considerable crystallizability and hence is poor in transparency, resulting in a significant attenuation. There have also been disclosed copolymers comprising hexafluoropropylene or trifluoroethylene as a third comonomer for controlling the crystallizability (Jap. Pat. Appln. Kokai (Laid-Open) Nos. 63-21606, 63-66509 and 63-143509). However, when the components, composition or melt index of a ternary copolymer is different from or outside the respective ranges of the components, composition and melt index range of the present invention, employment of the ternary copolymer can yield only plastic optical fibers having such a low heat resistance that the loss continues to increase at high temperatures.

Thus, conventional cladding materials for plastic optical fibers and plastic optical fibers comprising such materials, have both merits and demerits, and there has not yet been realized a plastic optical fiber which is excellent in all respects, for example, attenuation, flexibility, mechanical properties and heat resistance.

SUMMARY OF THE INVENTION

It is an object of the present invention to provide a cladding material for a plastic optical fiber, the cladding material having a high compatibility with the core material of the fiber, excellent adhesion to core material, a low refractive index and excellent transparency and mechanical properties; and a plastic optical fiber fabricated by the use of said cladding material, said fabricated fiber having excellent characteristics, for example, low loss, large numerical aperture, excellent mechanical properties and processability, a low loss even in the case where the fabricated fiber is in a bent state, and a stable attenuation at 650 nm light wavelength of 200 dB/km or less even in the case where the fabricated fiber is allowed to stand at a high temperature of 85° C. and a high humidity of 95% for an extended period of time.

In order to develop a plastic optical fiber having the aforementioned excellent characteristics, the present inventors have devoted themselves to research and consequently found that a vinylidene fluoride-trifluoroethylene-hexafluoroacetone ternary random copolymer having a specific composition and melt index, is a resin which has excellent mechanical properties, a high compatibility with methyl methacrylate resins, excellent adhesion to methyl methacrylate resins, very low crystallizability and high transparency, and hardly decreases in transparency due to the control of progress of crystallization even in an atmosphere of 80° to 90° C. Accordingly, the present inventors have found that a cladding material comprising this ternary copolymer and a plastic optical fiber fabricated by the use of a polymethyl methacrylate resin as core material and the ternary copolymer as cladding material can achieve the object of the present invention. On the basis of the above finding, the present invention has been accomplished.

DETAILED DESCRIPTION OF PREFERRED EMBODIMENTS

The present invention is related to a cladding material for plastic optical fibers comprising a vinylidene fluoride-trifluoroethylene-hexafluoroacetone copolymer which comprises 3.5 to 6.5 mole % of hexafluoroacetone units, a molar ratio of vinylidene fluoride unit to trifluoroethylene unit of 3 to 6:1, and a melt index of 10 to 60 g/10 min; and a plastic optical fiber comprising a core and a cladding, said core comprising a methyl methacrylate homopolymer or copolymer which comprises over 50% by weight of methyl methacrylate units as the core material and said cladding comprising the aforesaid vinylidene fluoride-trifluoroethylenehexafluoroacetone copolymer as the cladding material.

As the cladding material for plastic optical fibers of the present invention, a ternary copolymer of vinylidene fluoride, trifluoroethylene and hexafluoroacetone is used. In this ternary copolymer, the trifluoroethylene units serves mainly to control the crystallizability. The molar ratio of vinylidene fluoride unit to trifluoroethylene unit should be in the range of 3 to 6:1 by mole. When the content of trifluoroethylene units is so high that the aforesaid molar ratio becomes less than 3:1, the resulting resin would have a substantially small amount of crystallizability and excellent transparency, but would be too flexible and would have a lowered thermosoftening temperature. Therefore, this copolymer would not be useful as a cladding material for plastic optical fibers. Furthermore, crystals of vinylidene fluoride-trifluoroethylene, namely, b-type zigzag crystals, tend to grow in the copolymer, resulting in an marked increase of attenuation and a remarkable lowering of the heat resistance. On the other hand, when the aforesaid molar ratio is more than 6:1, the resulting copolymer would have crystallizability.

The hexafluoroacetone units serve to improve the flexibility of the copolymer and the compatibility with the core material and control the crystallizability, by the introduction of an ether linkage into the main chain of the polymer. The content of hexafluoroacetone units should be in the range of 3.5 to 6.5 mole %, preferably 5.0 to 6.5 mole %. When the content exceeds 6.5 mole %, the resulting copolymer has good transparency and compatibility, but would be soft and would have elastomeric properties, so that its melt spinning is difficult because of the large fluctuation of the fiber diameter. Moreover, the thermosoftening temperature is greatly lowered, and hence the heat resistance is lowered. For example, pieces of the copolymer begin to be fused together with one another at about 80° C. On the other hand, when the content is less than 3.5 mole %, the resulting copolymer would have crystallizability, and therefore attenuation becomes serious and the heat resistance is not sufficient.

The vinylidene fluoride-trifluoroethylenehexafluoroethylene copolymer, i.e., the cladding material of the present invention has a transparency which is very close to that of an amorphous polymer because of the remarkable control of crystallizability, is excellent in compatibility with and adhesion to the methyl methacrylate resin core material. The cladding material of the present invention also has a low refractive index of about 1.395 1.399 because of the copolymerization of monomers having high fluorine contents. Moreover, said copolymer does not undergo deterioration such as thermal decomposition and coloration at spinning temperatures of 200° to 270° C., and because of such an excellent thermal stability, it permits easy fabrication of a plastic optical fiber by composite spinning. In addition, said copolymer has an excellent resistance to chemicals such as acids and alkalis. Furthermore, it has an excellent weather resistance characteristic of fluorine-containing resins. For example, its appearance does not change for 2000 hours or more in an accelerated weathering test by means of a weather meter.

As a method for producing the vinylidene fluoride-trifluoroethylene-hexafluoroacetone copolymer, i.e., the cladding material of the present invention, a conventional radical polymerization method can be employed. In this case, the reaction is carried out in a conventional organic solvent at a temperature in the range of 0° to 130° C. by use of an oil-soluble free-radical initiator. The organic solvent includes, for example, saturated hydrocarbons such as n-hexane, n-heptane and the like; fluorinated solvents such as dichlorotetrafluoroethane, trichlorotrifluoroethane and the like; ester solvents; and ketone solvents.

In order for the plastic optical fiber of the present invention to have excellent performance characteristics, the core-cladding interface should be smooth and free from unconformity. For satisfying this requirement, it is necessary that the melt index (ASTM-1238, test temperature 230° C., load 3.8 kg, inside diameter of die 2.0955 mm) of the cladding material should be 10 to 60 g/10 min. When the melt index is too small, fluctuation of the fiber diameter is very large due to the high frictional resistance between the cladding material and the wall surface of the die, so that the shaping thereof into fibers is impossible. Therefore, it should not be less than 10 g/10 min. When the melt index is too large, shaping thereof into fibers is also possible and further, in this case, the plastic optical fiber would initially have a low attenuation. However, when this plastic optical fiber is coated with polyethylene to form a cord and placed in a thermohygrostat chamber having a temperature of 85° C. and a humidity of 95%, surprisingly, the attenuation value of this cord would be rapidly increased. Therefore, its melt index should not be more than 60 g/10 min, more preferably less than 40 g/10 min.

As the methyl methacrylate polymer resin used as the core material of the plastic optical fiber of the present invention, there can be used a methyl methacrylate homopolymer or copolymer which comprises over 50% by weight of methyl methacrylate units. Comonomers of this copolymer include, for example, alkyl acrylates such as methyl acrylate, ethyl acrylate and the like, alkyl methacrylates such as ethyl methacrylate, propyl methacrylate, bornyl methacrylate and the like, maleimides such as o-methylphenylmaleimide, cyclohexylmaleimide, phenylmaleimide and the like, methacrylic acid, acrylic acid, maleic anhydride, and styrene.

As a method for spinning the plastic optical fiber of the present invention, it is advantageous to employ, for example, a composite melt spinning method, which comprises subjecting one or more monomers such as methyl methacrylate purified by a conventional method to solution polymerization, bulk polymerization or block polymerization introducing the resulting polymer into an extruder, and allowing the core material and the cladding material in molten state to form a core-cladding structure by means of a special nozzle. The plastic optical fiber thus spun is usually subjected to a 1.2- to 3.0-fold drawing treatment immediately after the spinning in order to impart mechanical strength such as flexibility, elasticity, tensile strength, etc.

A bare plastic optical fiber comprising a core and a cladding layer can be obtained in a manner mentioned above.

A bare plastic optical fiber can be used as it is, however, it is preferred to coat the bare plastic optical fiber with a jacket when the optical fiber is used under harsh circumstances or when it is used under a condition that a higher reliability is required.

As a material for the jacket, there is examplified a polymer such as a polyethylene, polyvinyl chloride, polypropylene, ethylene-vinyl acetate copolymer, nylon, a fluorinated polyolefin and the like.

The present invention is further illustrated with the following examples, which should not be construed as limiting the scope of the invention.

Physical properties are measured in the following manner:

① Refractive index

Measurement is carried out by means of an Abbe refractometer Model 1 (mfd. by ATAGO Co., Ltd.) in a room thermostated at 23° C.

② Melt index

Measurement is carried out by means of a melt indexer mfd. by Toyo Seiki Co., LTD. under the following conditions: ASTM-1238, test temperature 230° C., load 3.8 kg, inside diameter of die 2.0955 mm.

③ Attenuation

Measurement is carried out by a 52m - 2m cutback method by means of a fiber loss spectrometer FP-889 mfd. by OPELECS CO., LTD. An incidental angle employed is 0.15 radian.

EXAMPLE 1

A plastic optical fiber of the present invention is fabricated using polymethyl methacrylate resin (comprising 99.5% by weight of methyl methacrylate, 0.5% by weight of methyl acrylate; weight average molecular weight: 98,000) as the core material and a vinylidene fluoride-trifluoroacetone-hexafluoroacetone copolymer (ratio between monomer units 80:14:6 by mole %) as the cladding material. The cladding material has a refractive index of 1.395 and a MI value of 32.1.

The structure of the thus obtained bare plastic optical fiber consists of a core having a diameter of 0.98 mm and a cladding layer having an outer diameter of 1.0 mm.

The attenuation of the index fiber is 87 dB/km at a wavelength of 570 mm and 134 dB/km at a wavelength of 650 nm. The fiber is placed in a thermostat at 80° C. and the change of attenuation is measured and found that the attenuation is so stable that after 1,000 hours, it is 88 dB/km at a wavelength of 570 nm and 134 dB/km at a wavelength of 650 nm.

When the bare plastic optical fiber is coated with a polyethylene (NUC-9109: mfd. by Nippon Unicar CO., LTD.) to form a cord having an outdiameter of 2.2 mm, the attenuation of the cord is 92 dB/km at a wavelength of 570 nm and 132 dB/km at a wavelength of 650 nm. The cord is placed in a thermohygrostat chamber having a temperature of 85° C. and a humidity of 95% and the change of attenuation is measured and found that at a wavelength of 650 nm, the attenuation is increased by 32 dB/km to become 164 dB/km in 24 hours and then became so stable that after 1,000 hours, it remained unchanged as follows: 90 dB/km at 570 nm and 164 dB/km at 650 nm. After 2000 hours, values of the attenuation at two wavelengths are slightly increased and reached 113 dB/km at a wavelength of 570 nm and 171 dB/km at a wavelength of 650 nm.

EXAMPLES 2 to 8

Plastic optical fibers and cords are fabricated and evaluated under the same conditions as in Example 1, except that the composition and melt index of the vinylidene fluoride-trifluoroethylene-hexafluoroacetone copolymer cladding material are changed as shown in Table 1. The measurement results of attenuation in the individual fibers and cords are shown in Table 1.

EXAMPLE 9

A 2 m each of a bare plastic optical fiber is prepared by cutting the bare fiber obtained in Example 1. The relative transmission rates of thus prepared bare plastic optical fibers in a wound state are measured by using a LED light source (Anritsu handy visible light source MG927A) and an optical meter (Anritsu handy power meter ML 96B).

The relative transmission rates of the bare fibers when the bare fibers are wound around a bar having a diameter of 10 mm 1 to 4 times are 75%, 56%, 42% and 33%, respectively, compared with the optical power of the bare fiber in a straight state.

On the other hand, the relative transmission rates of the bare fibers in which a fluorinated methacrylate copolymer is used as a cladding material when the bare fibers are wound around a bar having a diameter of 10 mm 1 to 4 times are 50%, 26%, 17% and 14%, respectively, compared with the optical fiber in a straight state.

COMPARATIVE EXAMPLE 1

A plastic optical fiber is fabricated using polymethyl methacrylate resin as the core material and a vinylidene fluoride-trifluoroethylene-hexafluoroacetone copolymer (68:23:9) as the cladding material. The cladding material has a MI value of 21.1 g/10 in and a refractive index of 1.389.

The attenuation of the intact fiber is 134 dB/km at 570 nm and 195 dB/km at 650 nm. When the fiber is placed in a thermostat at 80° C. as in Example 1, the values of the attenuation at 570 nm and 650 nm are increased to 415 dB/km and 447 dB/km, respectively, after 1,000 hours. Moreover, the attenuation is still unstable and on the upward trend.

When the fiber is taken out of the thermostat chamber, pieces of the fiber has been fused together in places with one another.

When a cord is fabricated in the same manner as in Example 1, the attenuation of the cord is 113 dB/km at 570 nm and 182 dB/km at 650 nm. When the cord is placed in a thermo-hygrostat chamber having a temperature of 85° C. and a humidity of 95%, the transmission loss after 1,000 hours is 393 dB/km at 570 nm and 418 dB/km at 650 nm and moreover is not stable.

COMPARATIVE EXAMPLE 2

A plastic optical fiber is fabricated using polymethyl methacrylate resin as the core material and a vinylidene fluoride-trifluoroethylene-hexafluoroacetone copolymer (ratio between monomer units 67:30:3 by mole) as the cladding material. The cladding material has a melt index of 27.3 g/10 min and a refractive index of 1.397.

The attenuation of the intact fiber is 285 dB/km at 570 nm and 290 dB/km at 650 nm.

COMPARATIVE EXAMPLE 3

A plastic optical fiber is fabricated using polymethyl methacrylate resin as the core material and a vinylidene fluoride-hexafluoroacetone copolymer (ratio between monomer units 92:8 by mole) as the cladding material. The cladding material has a melt index of 16.8 g/10 min and a refractive index of 1.391.

The fiber is whitely turbid and its attenuation is 2,700 dB/km at 570 nm and 2,628 dB/km at 650 nm.

COMPARATIVE EXAMPLE 4

An attempt is made to fabricate a plastic optical fiber by using a resin having the same composition as in Example 1 and a melt index of 9.7 g/10 min as the cladding material, but spinning is impossible because of a large fluctuation of the fiber diameter.

COMPARATIVE EXAMPLE 5

A plastic optical fiber is fabricated using polymethyl methacrylate resin as the core material and a resin having the same composition as in Example 1 and a melt index of 79.4 g/10 min as the cladding material.

The attenuation of the intact fiber is 64 dB/km at 570 nm and 127 dB/km at 650 nm. When the fiber is placed in a thermostat chamber at 80° C. as in Example 1, values of the attenuation at the two wavelengths are rapidly increased and reached 575 dB/km and 590 dB/km, respectively, after 500 hours, and thereafter they continued to be increased.

When a cord is fabricated in the same manner as in Example 1, the attenuation of the cord is 69 dB/km at 70 nm and 133 dB/km at 650 nm. When the cord is placed in a thermo-hygrostat having a temperature of 85° C. and a humidity of 95%, values of the attenuation at the two wavelengths are rapidly increased and reached 481 dB/km and 479 dB/km, respectively, after 500 hours, and thereafter they continued to be increased.

COMPARATIVE EXAMPLE 6

A plastic optical fiber is fabricated using polymethyl methacrylate resin as the core material and a vinylidene fluoride-tetrafluoroethylene copolymer (ratio between monomer units 81:19 by mole) as the cladding material, and then coated with polyethylene to obtain a cord.

The bare fiber is placed in a thermostat chamber having a temperature of 80° C., as in Example 1, and the change of attenuation is measured. Before the fiber is placed in the thermostat, values of the attenuation are 89 dB/km at 570 nm and 158 dB/km at 650 nm, and after the lapse of 1000 hours, they are increased to 331 dB/km and 266 dB/km, respectively. And thereafter, they continued to be increased.

Moreover, the cord is placed in a thermohygrostat chamber having a temperature of 85° C. and a humidity of 95%, as in Example 1 and change of attenuation is measured. Before the cord is placed in the thermohygrostat chamber, the values of the attenuation are 88 dB/km and 158 dB/km at 650 nm, and after the lapse of 400 hours, they are increased to 550 dB/km and 363 dB/km, respectively. And thereafter, they continued to be increased.

COMPARATIVE EXAMPLE 7

A plastic optical fiber is fabricated using polymethyl methacrylate resin as the core material and a vinylidene fluoride-tetrafluoroethylene-hexafluoropropylene copolymer (ratio between monomer units 88:10:2 by mole) as the cladding material, and then coated with polyethylene to obtain a cord.

The bare fiber is placed in a thermostat having a temperature of 80° C., as in Example 1, and the change of attenuation is measured. Before the fiber is placed in the thermostat chamber, the values of the attenuation are 85 dB/km at 570 nm and 137 dB/km at 650 nm, and after the lapse of 1000 hours, they are increased to 86 dB/km and 139 dB/km, respectively.

Moreover, the cord is placed in the thermohygrostat chamber having a temperature of 85° C. and a humidity of 95%, as in Example 1, and the change of attenuation is measured. Before the cord is placed in the thermohygrostat chamber, the values of the attenuation are 83 dB/km at 570 nm and 139 dB/km at 650 nm, and after the lapse of 1000 hours, they are increased to 237 dB/km and 272 dB/km, respectively. And thereafter, they continued to be increased.

The results of Comparative Examples 1 to 7 are shown in Table 2.

TABLE 1

| Example | Composition VDF unit: TrFE unit: HFA unit (molar ratio) | MI 230° C. 3.8 kg (g/10) | Attenuation (A) 570 nm/650 nm (dB/km) | Attenuation (B) 570 nm/650 nm (dB/km) | Attenuation (C) 570 nm/650 nm (dB/km) | Attenuation (D) 570 nm/650 nm (dB/km) |
|---|---|---|---|---|---|---|
| Example 1 | 80:14:6 | 32.1 | 87/134 | 88/134 | 90/164 | 113/171 |
| Example 2 | 80:14:6 | 49.2 | 79/129 | 98/150 | 110/173 | 115/188 |
| Example 3 | 80:14:6 | 13.8 | 93/148 | 93/149 | 95/182 | 97/176 |
| Example 4 | 74:22:4 | 21.2 | 93/145 | 96/149 | 97/178 | 117/188 |
| Example 5 | 74:22:4 | 57.0 | 88/139 | 105/153 | 118/185 | 137/190 |
| Example 6 | 76:18:6 | 19.8 | 93/147 | 96/150 | 97/180 | 116/185 |
| Example 7 | 76:18:6 | 27.3 | 87/135 | 89/136 | 89/166 | 108/174 |
| Example 8 | 76:18:6 | 38.5 | 84/132 | 86/133 | 90/166 | 110/178 |

Note:
Attenuation (A): intact fiber (bare POF)
Attenuation (B): dry heat, 80° C., 1000 hr (bare POF)
Attenuation (C): wet heat, 85° C., 95% RH, 1000 hr (POF core coated with polyethylene)
Attenuation (D): wet heat, 85° C., 95% RH, 2000 hr (POF core coated with polyethylene)
VDF: vinylidene fluoride
TrFE: trifluoroethylene
HFA: hexafluoroacetone

TABLE 2

| Example | Composition VDF unit: TrFE unit: HFA unit (molar ratio) | MI 230° C. 3.8 kg (g/10) | Attenuation (A) 570 nm/650 nm (dB/km) | Attenuation (B) 570 nm/650 nm (dB/km) | Attenuation (C) 570 nm/650 nm (dB/km) |
|---|---|---|---|---|---|
| Comparative Example 1 | VDF:TrFE:HFA-68:23:9 | 21 | 134/195 | 415/447 | 393/418 |
| Comparative Example 2 | VDF:TrFE:HFA-65:30:3 | 27 | 285/290 | — | — |
| Comparative Example 3 | VDF:HFA-92:8 | 17 | 2700/2628 | — | — |
| Comparative Example 4 | VDF:TrFE:HFA-80:14:6 | 9.7 | Spinning was impossible | — | — |
| Comparative Example 5 | VDF:TFE-81:19 | 79 | 64/127 | 575/590*1 | 481/479*1 |
| Comparative Example 6 | VDF:TFE-81:19 | 32 | 89/158 | 331/266 | 550*2/363 |
| Comparative Example 7 | VDF:TrFE:HFA-88:10:2 | — | 85/137 | 86/139 | 237/272 |

Note:
Attenuation (A), (B) and (C): as defined in Table 1
VDF, TrFE and HFA: as defined in Table 1
TFE: tetrafluoroethylene
*1after the lapse of 500 hours
*2after the lapse of 400 hours As described above, the plastic optical fiber of the present invention is obtained by using as the cladding material a vinylidene fluoride-trifluoroethylene-hexafluoroacetone ternary copolymer which has a low refractive index and is excellent in transparency, mechanical properties, compatibility with core material, adhesion to core material, etc., and the fiber has a low loss and a large numerical aperture, and is excellent in mechanical properties, processability, flexibility, and the like. Furthermore, this cladding material can be produced by polymerization so as to have a melt index value in the range of from 10 g/10 min to 60 g/10 min, has no elastomeric properties even at high temperatures, and causes neither a peeling of the cladding from the core by heat shrinkage or deformation, nor a cracking of the cladding.

In addition, the cladding material is moderately flexible, so that the core-cladding interface is only slightly disturbed by bending or stretching. Therefore, even when it is used in a narrow place, for example, in a sensor or a wiring in an instrument, the bending loss is slight and hence the cladding material is acceptable for practical use. In a circumstance of 80° C., in the case of a plastic optical fiber using a vinylidene fluoridetetrafluoroethylene copolymer as the cladding material, the cladding material becomes whitely turbid owing to the progress of the crystallization and attenuation is increased more than 200 dB/km in 1,000 hours. In a case of a plastic optical fiber cord using a vinylidene fluoride-tetrafluoroethylene-hexafluoropropylene copolymer as the cladding material, attenuation is increased more than 200 dB/km in 1000 hours at a high temperature of 85° C. at a humidity of 95%. On the other hand, the cladding material of the present invention hardly undergoes the progress of crystallization and even when the plastic optical fiber of the present invention is allowed to stand at a high temperature of 85° C. and a humidity of 95% for an extended period of time, its attenuation is less than 200 dB/km at 650 nm and is stable, indicating that the fiber has an excellent heat resistance.

What is claimed is:

1. A cladding material for a plastic optical fiber comprising a vinylidene fluoride-trifluoroethylenehexafluoroacetone copolymer which comprises 3.5 to 6.5% by mole of hexafluoroacetone units, a molar ratio of vinylidene fluoride unit to trifluoroethylene unit of 3 to 6:1, and a melt index of 10 to 60 g/10 min.

2. A plastic optical fiber comprising a core and a cladding, said core comprising a methyl methacrylate homopolymer or copolymer which comprises over 50% by weight of methyl methacrylate units as the core material and said cladding comprising a vinylidene fluoridetrifluoroethylene-hexafluoroacetone copolymer 3.5 to 6.5% by mole of hexafluoroacetone units, a molar ratio of vinylidene fluoride unit to trifluoroethylene unit of 3 to 6:1, and a melt index of 10 to 60 g/10 min as the cladding material.

3. A plastic optical fiber cord obtained by coating a bare plastic optical fiber claimed in claim 2 with a resin.

4. The plastic optical fiber cord according to claim 3 whose attenuation at 650 nm after having been placed said fiber under environments whose temperature is 85° C. and whose relative humidity is 95% for 1000 hours is 200 dB or less.

* * * * *